US009942664B2

(12) United States Patent
Mao et al.

(10) Patent No.: US 9,942,664 B2
(45) Date of Patent: Apr. 10, 2018

(54) SPEAKER

(71) Applicants: Lubin Mao, Shenzhen (CN); Hongxing Wang, shenzhen (CN); Shun Guo, shenzhen (CN); Rongguan Zhou, shenzhen (CN)

(72) Inventors: Lubin Mao, Shenzhen (CN); Hongxing Wang, shenzhen (CN); Shun Guo, shenzhen (CN); Rongguan Zhou, shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/297,561

(22) Filed: Oct. 19, 2016

(65) Prior Publication Data

US 2017/0347200 A1 Nov. 30, 2017

(30) Foreign Application Priority Data

May 26, 2016 (CN) ..... 2016 2 0489133 U

(51) Int. Cl.

| | |
|---|---|
| ***H04R 9/06*** | (2006.01) |
| ***H04R 7/18*** | (2006.01) |
| ***H04R 7/12*** | (2006.01) |
| ***H04R 9/02*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 2207/021* (2013.01); *H04R 2231/001* (2013.01)

(58) Field of Classification Search

CPC ... H04R 7/04; H04R 7/06; H04R 7/12; H04R 7/125; H04R 7/127; H04R 7/26; H04R 9/025; H04R 9/04; H04R 9/041; H04R 9/043; H04R 9/045; H04R 9/046; H04R 9/06; H04R 2207/021; H04R 2231/001

See application file for complete search history.

(56) References Cited

U.S. PATENT DOCUMENTS

| | | | | |
|---|---|---|---|---|
| 5,664,024 A * | 9/1997 | Furuta | H04R 7/127 | 381/396 |
| 6,269,168 B1 * | 7/2001 | Tagami | H04R 1/24 | 381/401 |
| 2011/0188698 A1 * | 8/2011 | Milot | H04R 9/027 | 381/398 |

* cited by examiner

*Primary Examiner* — Joshua Kaufman
(74) *Attorney, Agent, or Firm* — Na Xu; IPro, PLLC

(57) ABSTRACT

A speaker includes a frame having an accommodation space; a magnetic circuit system accommodated in the accommodation space; and a vibration system accommodated in the accommodation space for generating sound. The vibration system includes a diaphragm and a voice coil. The diaphragm includes a first part fixed with the frame and a second part arranged between the first part and the frame. One end of the second part is connected with the first part. The accommodation space is divided by the second part into a first accommodation space for accommodating the magnetic circuit system and a second accommodation space for accommodating the voice coil.

9 Claims, 6 Drawing Sheets

SPEAKER

FIELD OF THE INVENTION

The present invention relates to the field of acoustic-electro transducers, and more particularly to a speaker.

DESCRIPTION OF RELATED ART

More and more mobile electronic devices occur in the daily lives of people along with development of technology, especially rapid development of the mobile communication technology, for example, the intelligent cell phone, the tablet PC, the notebook computer and the multifunctional media player have become the indispensable articles of daily use of people. The voice playing devices are the indispensable parts in these mobile electronic equipment. Moreover, the user experience will be affected directly by the voice quality when the user uses these mobile electronic equipment.

The structure design of a speaker will affect the quality of voice playing directly. The speaker of relevant technology comprises a diaphragm having a dome covering a magnetic circuit system; and a vibration space should be reserved between the diaphragm and a magnet of the magnetic circuit system.

However, the total thickness of the speaker is limited by the magnetic circuit system and the vibration space, and cannot be thinned.

Therefore, it is necessary to provide an improved speaker to overcome above disadvantage.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments. To make the technical problems to be solved, technical solutions and beneficial effects of present disclosure more apparent, the present disclosure is described in further detail together with the figures and the embodiments. It should be understood the specific embodiments described hereby is only to explain this disclosure, not intended to limit this disclosure.

Embodiment 1

Figure 1:
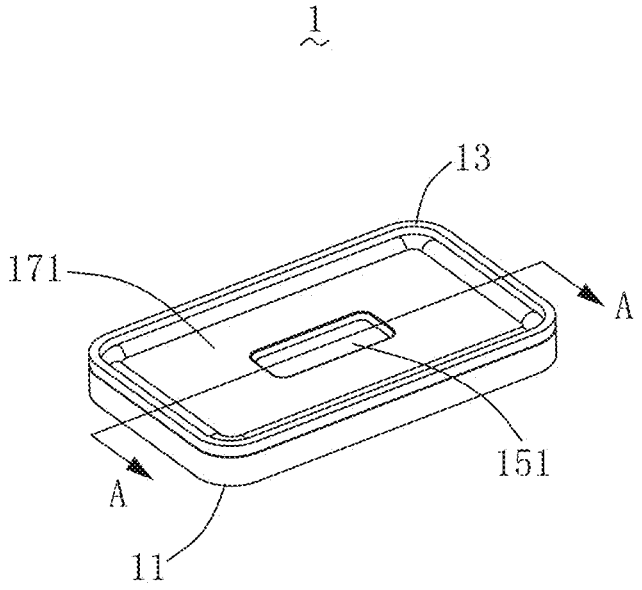
FIG. 1 is an isometric view of a speaker in accordance with a first exemplary embodiment of the present disclosure.
Figure 2:
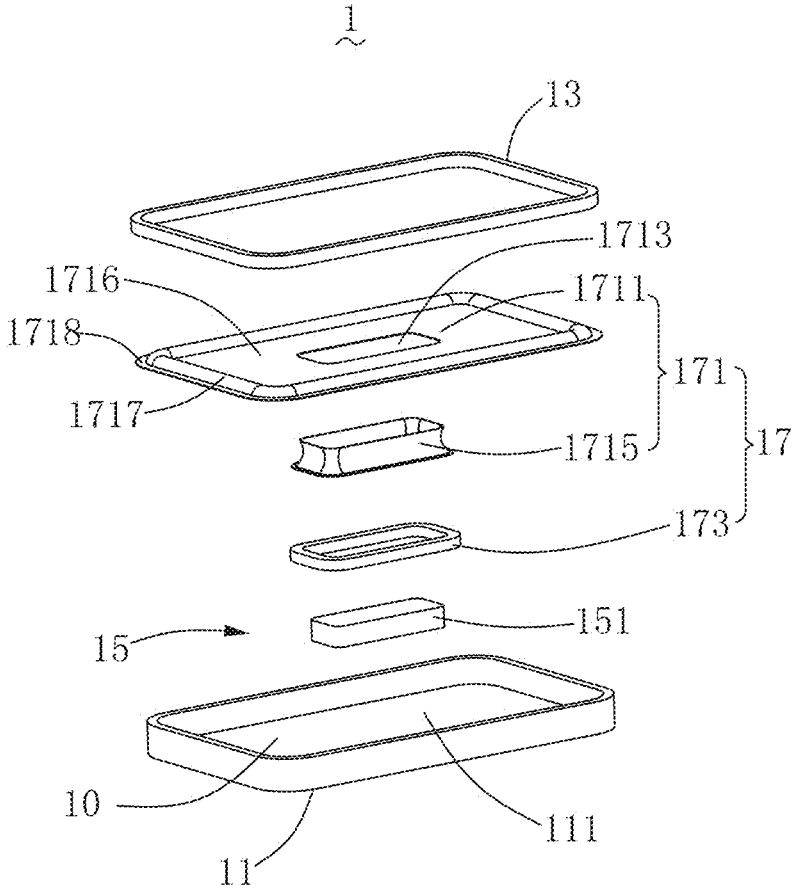
FIG. 2 is an exploded view of the speaker in FIG. 1.
Figure 3:
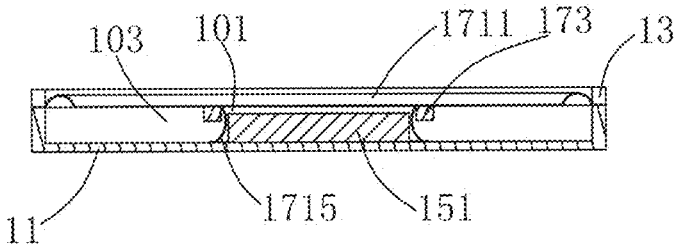
FIG. 3 is a cross-sectional view of the speaker taken along Line A-A in FIG. 1.

As shown in FIGS. 1-3, the present disclosure provides a speaker 1 comprising a frame 11 having an accommodation space 10, a framework 13 which is installed over the frame 11, a magnetic circuit system 15 which is accommodated in the accommodation space 10 and a vibration system 17 which is accommodated in the accommodation space 10 and vibrates after being driven by the magnetic circuit system 15. The frame 11 comprises a bottom wall 111.

The vibration system 17 comprises a diaphragm 171 and a voice coil 173 which drives the diaphragm 171 to vibrate; the external peripheral edge of the diaphragm 171 is held between the frame 11 and the framework 13, playing a role of fixation; the framework 13 is not required to set in other embodiments, and the diaphragm 171 is fixed on the frame 11 directly; the magnetic circuit system 15 comprises a magnet 151; and the diaphragm 171 is arranged over the magnet 151.

The diaphragm 171 comprises a first part 1711 which is fixed with the frame 11 and applied to vibration and sound production and a second part 1715 which is arranged between the first part 1711 and the frame 11. The second part 1715 is presented as the hollow structure with periphery sealed; one end of the second part 1715 is connected with the lower surface of the first part 1711; and the accommodation space 10 is divided into a first accommodation space 101 for accommodating the magnetic circuit system 15 and a second accommodation space for accommodating the voice coil 173 by using the second part 1715; the first accommodation space 101 is disconnected with the second accommodation space 103; the voice coil 173 is driven by the magnet 151 to vibrate in the second accommodation space 103; the first part 1711 of the diaphragm 171 is provided with a through hole 1713 which is opposite to the magnet 151 in order to avoid the magnet 151. Moreover, the first part 1711 comprises a dome 1716, corrugated rims 1717 arranged at the periphery of the dome and a connection part 1718 which extends outwards from the corrugated rims 1717 and is fixed with the frame 11; and the through hole 1713 is arranged on the dome 1716.

The projection of the upper surface of the magnetic circuit system 15 on the diaphragm 171 along the direction of vibration is located in the through hole 1713; therefore, the diaphragm 171 is ensured not to collide with the magnet 151 when the speaker 1 works, preferably, the upper surface of the magnetic circuit system 15 does not exceed the upper surface of the first part 1711 of the diaphragm 171.

In this embodiment, the second part 1715 is connected with the edge of the through hole 1713 and the bottom wall of the frame and is arranged in the space formed by the voice coil 173 and the magnet 151 circularly. Specifically, one end of the second part 1715 close to the first part 1711 is connected with the lower surface of the first part 1711, and one end thereof far from the first part 1711 is connected with the bottom wall 111 of the frame 11, therefore the second accommodation space 103 formed by the frame 11, the second part 1715 and the first part 1711 is presented as the closed space. In other embodiments, one end of the second part far from the first part 1711 can also be connected with the magnet 151, therefore the second accommodation space 103 formed by the frame 11, the magnetic circuit 151, the second part 1715 and the first part 1711 is presented as the closed space.

In this embodiment, the first part 1711 is adhered to and fixed with the second part 1715 by means of glue.

Embodiment 2

Figure 4:
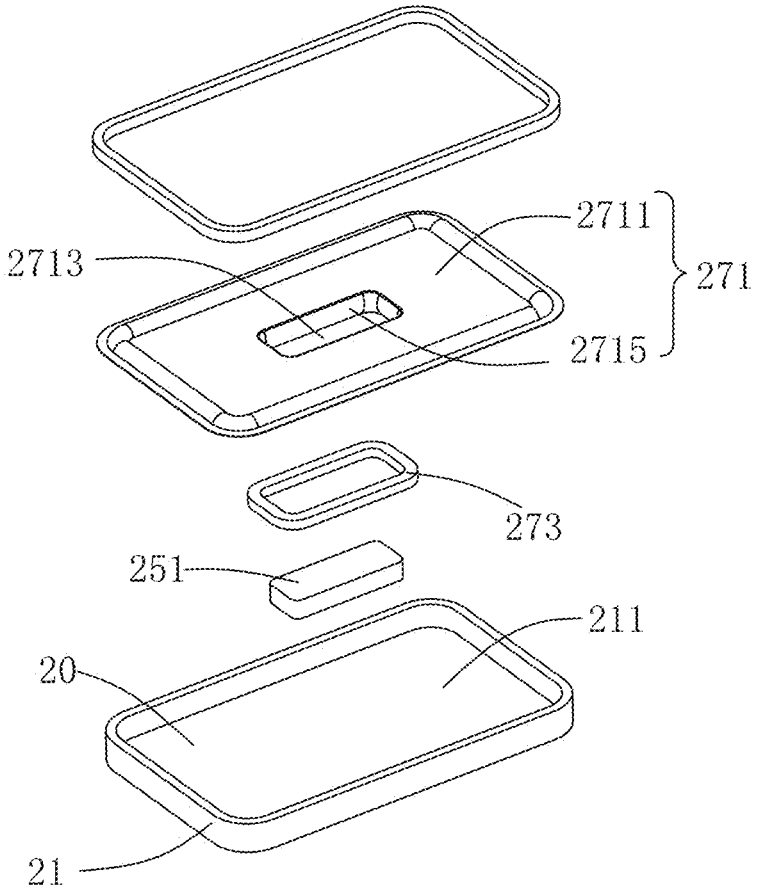
FIG. 4 is an exploded view of a speaker in accordance with a second exemplary embodiment of the present disclosure.
Figure 5:
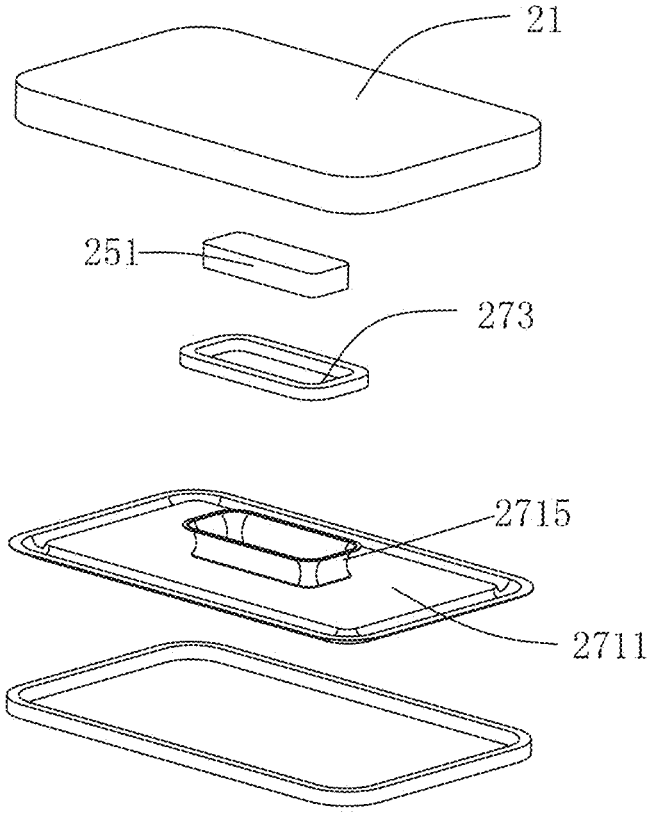
FIG. 5 is an exploded view of the speaker in FIG. 4, from another aspect.

As shown in FIGS. 4-5, the diaphragm 271 comprises a first part 2711 and a second part 2715 which is arranged in the accommodation space 20. The first part 2711 of the diaphragm 273 is provided with a through hole 2713 which is opposite to the magnet 251 in order to avoid the magnet 251. One end of the second part 2715 far from the first part 2711 is connected with the bottom wall 211 of the frame 21. Of course, one end of the second part 2715 far from the first part 2711 can also be connected with the magnet 251 in the way of sealing.

In this embodiment, the second part 2715 extends from the edge of the through hole 2713 towards to the bottom wall 211 and is subjected to one-piece molding.

The first part 2711 and the second part 2715 are processed into the integrated structure; therefore the connection and sealing effects of them are more excellent, and the sound leakage can be avoided because too many parts embedded and gaps close to the vocal cavity are prevented, and the performance of the speaker is further improved.

Embodiment 3

Figure 6:
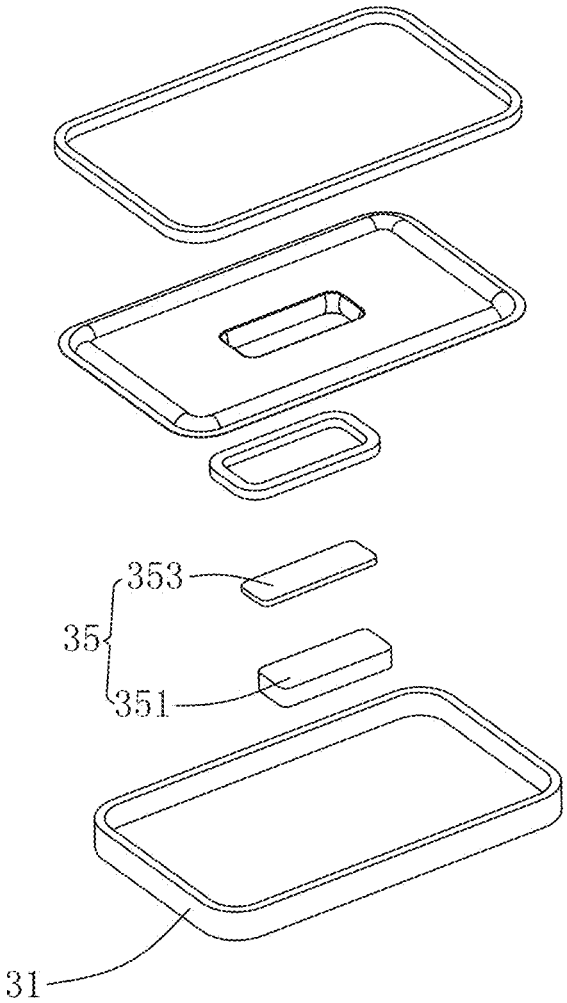
FIG. 6 is an exploded view of a speaker in accordance with a third exemplary embodiment of the present disclosure.

As shown in FIG. 6, the magnetic circuit system 35 comprises the magnet 351 and a polar core 353 which covers the upper surface of said magnet 351.

The magnetic flux leakage of the magnet 351 is solved, and the magnetic field is shielded effectively after adding the polar core 353 produced by using the permeability magnetic material; therefore, the strength of magnetic field on the surface of the frame 31 is weakened, and the magnetic flux leakage of the product is reduced effectively.

Compared with relevant technology, the through hole can prevent the diaphragm and the magnetic circuit system from collision by arranging the through hole at the place of the diaphragm opposite to the magnetic and adding the second part in the speaker of the utility model; therefore, the vibration space can be taken as the main part in terms of thickness of the speaker and will not be limited by the thickness of the magnet, and the performance of the speaker is further improved when thinning the speaker.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker comprising:

a frame having an accommodation space, the frame comprising a bottom wall;

a magnetic circuit system accommodated in the accommodation space;

a vibration system accommodated in the accommodation space for generating sound, the vibration system comprising a diaphragm and a voice coil, the diaphragm including a first part fixed with the frame and a second part arranged between the first part and the bottom wall; one end of the second part being connected with the first part, the other end of the second part being connected with the bottom wall; wherein the accommodation space is divided by the second part into a first accommodation space for accommodating the magnetic circuit system and a second accommodation space for accommodating the voice coil; the first accommodation space is not communicated with the second accommodation space; and wherein the first part of the diaphragm is provided with a through hole opposite to the magnetic circuit system for avoiding the magnetic circuit system.

2. The speaker as described in claim 1, wherein a projection of an upper surface of the magnetic circuit system on the diaphragm along a vibration direction of the diaphragm is located in the through hole.

3. The speaker as described in claim 1, wherein one end of the second part close to the first part is connected with a lower surface of the first part.

4. The speaker as described in claim 3, wherein the second part extends from an edge of the through hole of the first part towards the bottom wall and is subjected to one-piece molding.

5. The speaker as described in claim 3, wherein the second part is adhered to and fixed with the first part by means of glue.

6. The speaker as described in claim 3, wherein one end of the second part far from the first part is also connected with the magnetic circuit system.

7. The speaker as described in claim 1, wherein an upper surface of the magnetic circuit system does not exceed the upper surface of the first part of the diaphragm.

8. The speaker as described in claim 1, wherein the first part comprises a dome, corrugated rims arranged at the periphery of the dome, and a connection part extending outwardly from the corrugated rims and fixed with the frame; and the through hole is arranged in the dome.

9. The speaker as described in claim 1, wherein the second part is a hollow structure with a closed periphery.

* * * * *